US006402588B1

(12) United States Patent
Matsuo et al.

(10) Patent No.: US 6,402,588 B1
(45) Date of Patent: Jun. 11, 2002

(54) POLISHING APPARATUS

(75) Inventors: Hisanori Matsuo, Fujisawa; Hirokuni Hiyama, Tokyo; Yutaka Wada; Kazuto Hirokawa, both of Chigasaki, all of (JP)

(73) Assignee: Ebara Corporation, Tokyo (JP)

( * ) Notice: Subject to any disclaimer, the term of this patent is extended or adjusted under 35 U.S.C. 154(b) by 0 days.

(21) Appl. No.: 09/300,383

(22) Filed: Apr. 27, 1999

(30) Foreign Application Priority Data

Apr. 27, 1998 (JP) ..... 10-116744
Mar. 29, 1999 (JP) ..... 11-086871

(51) Int. Cl.[7] ..... B24B 49/00

(52) U.S. Cl. ..... 451/5; 451/21; 451/56; 451/287; 451/288; 451/443; 451/444

(58) Field of Search ..... 451/56, 285, 287, 451/288, 5, 21, 443, 444

(56) References Cited

U.S. PATENT DOCUMENTS 3,872,626 A * 3/1975 White ..... 451/285
4,513,538 A * 4/1985 Wolters et al. ..... 451/287
4,726,150 A * 2/1988 Nishio et al. ..... 451/291
5,035,087 A * 7/1991 Nishiguchi et al. ..... 451/285
5,113,622 A * 5/1992 Nishiguchi et al. ..... 451/285
5,567,199 A * 10/1996 Huber et al. ..... 451/285
5,605,494 A * 2/1997 Nishioka et al. ..... 451/287
5,681,212 A * 10/1997 Hayakawa et al. ..... 451/288
5,718,619 A * 2/1998 Merrill et al. ..... 451/287
5,733,175 A * 3/1998 Leach ..... 451/288
5,816,895 A * 10/1998 Honda ..... 451/288
5,827,112 A * 10/1998 Ball ..... 451/56
5,860,851 A * 1/1999 Beppu et al. ..... 451/287
5,975,994 A * 11/1999 Sandhu et al. ..... 451/56
6,059,921 A * 5/2000 Kato et al. ..... 451/443
6,093,088 A * 7/2000 Mitsuhashi et al. ..... 451/443
6,095,908 A * 8/2000 Torii ..... 451/56
6,113,464 A * 9/2000 Ohmori et al. ..... 451/56

FOREIGN PATENT DOCUMENTS

JP 61168462 7/1986
JP 5-138512 6/1993

* cited by examiner

*Primary Examiner*—M. Racuba
(74) *Attorney, Agent, or Firm*—Wenderoth, Lind & Ponack, L.L.P.

(57) ABSTRACT

The object of the present invention is to provide a polishing apparatus having a grinding member in a compact design that can provide high efficiency for both polishing and dressing operations, and prevents tilting of the grinding member even if the rotation axis thereof is moved away from the outer periphery of the object. A polishing apparatus for an object, comprises: an object holder for holding an object to be polished, such that a surface of the object to be polished faces upward; a dresser disk holder for holding a dresser disk for dressing, such that a dressing surface thereof faces upward; and a grinding member for polishing the object, and for being dressed by the dresser disk, by pressing and sliding the grinding member relative to the object and the dresser disk. Thereby, the surface to be polished and the dressing surface are arranged so as to be coploanar, and the grinding member having an abrasive surface facing downward, is disposed so as to straddle the surface to be polished of the object and the dressing surface of the dresser disk to perform polishing of the surface to be polished and dressing of the abrasive surface of the grinding member.

42 Claims, 8 Drawing Sheets

POLISHING APPARATUS

BACKGROUND OF THE INVENTION

1. Field of the Invention

The present invention relates to an apparatus for polishing objects such as semiconductor wafers, hard disks, glass substrates, liquid crystal display panels, and so on.

2. Description of the Related Art

A conventional chemical mechanical polishing (CMP) apparatus used in fabrication of, for example, semiconductor integrated circuit devices, is based on holding the semiconductor wafer in a rotating top ring and pressing the wafer against a polishing cloth mounted on a rotating turntable while supplying a polishing solution, including abrading particles to the polishing cloth. Hence, polishing is carried out mechanically by the abrading particles floating freely in the polishing solution, and chemically by a chemical solution at the pressing and sliding interface between the polishing cloth and the semiconductor wafer. However, such a CMP apparatus presents a problem in that, depending on the type of surface patterns and differences in the height of fine structures formed on the surface of the wafer, it was not possible to obtain a precisely polished flat and mirror surface on the wafer.

Therefore, in place of the CMP process, another polishing technology has been developed, based on a grinding member to produce a relative pressing and sliding motion against the wafer, in which abrading particles are bound in the grinding member and generated freely from the grinding member while water or a chemical solution is supplied at the sliding interface between the grinding member and the wafer. The polishing apparatus of the grinding member type includes variations using such as a ring-type grinding wheel attached on a supporting member or a cup-type grinding wheel having ring- shaped pellet attached on a supporting member. These grinding wheels include abrading particles bound therein.

FIG. 1 shows a cross sectional view of a conventional cup-type polishing apparatus using a grinding wheel. A wafer 100 is placed on the top surface of a disk-shaped wafer holder 80. A cup-type grinding wheel 90 comprises of a grinding wheel holder 93 and a ring-shaped grinding wheel 91, which is disposed above the wafer 100. The grinding wheel 91 is pressed and slided against the wafer 100. The wafer holder 80 and the wafer 100 are rotated in the direction of the arrow H while the grinding wheel 91 is rotated in the direction of the arrow J. Also, the grinding wheel 91 moves linearly in the radial direction of the wafer 100 (indicated by the arrows K). Thus, the entire surface of the wafer 100 is uniformly polished by the grinding wheel 91.

In this apparatus, the wafer holder 80 is surrounded with a table surface 95 so that even if the rotational axis m of the grinding wheel 90moves away from the outer periphery of the wafer 100, tilting of the grinding wheel 90 is prevented by supporting the grinding wheel 91 on the table surface 95.

This apparatus presents the following problems.

(1) In this design, it is difficult to adjust the surface levels between the wafer 100 and the table surface 95 so as to keep the same level therebetween, and basically, it is virtually impossible to attain a completely level surface.

(2) Polishing speed of the grinder 90 is rather slow, and the productivity is generally low.

(3) It is necessary to dress the grinding surface of the grinding wheel 91 after a given usage, to refurbish the polishing quality of the grinding wheel 91, using a separate dressing tool. However, when a grinding wheel is being dressed, the wafer 100 cannot be polished. Thus, not only the productivity of polishing is lowered, but additionally, because a space must be allocated for the dressing tool, it becomes difficult to design a compact polishing apparatus using a cup-type grinding wheel.

SUMMARY OF THE INVENTION

It is an object of the present invention to provide a polishing apparatus having a grinding member of a compact design that can provide high efficiency for both polishing and dressing operations, and prevents tilting of the grinding member even if the rotation axis thereof is moved away from the outer periphery of the object being polished.

According to the present invention, there is provided a polishing apparatus for polishing an object using a grinding member, comprising an object holder for holding an object to be polished such that a surface to be polished is facing upward, and a dresser disk holder for holding a dresser disk for dressing the grinding member such that a dressing surface of the dresser disk is facing upward. The surface to be polished and the dressing surface are arranged so as to be coplanar. While the grinding member is polishing the object, the grinding member is being dressed by the dresser disk.

The grinding member has an abrasive surface which is facing downward, and the abrasive surface is disposed so as to straddle the surface of the object to be polished and the dressing surface of the dresser disk. The polishing and dressing occur as a result of the grinding member being pressed against and slid relative to the object and the dresser disk.

Accordingly, the polishing apparatus of the present invention provides the following advantages compared with conventional polishing apparatus having a grinding member.

Even when the center of rotation of the grinding member moves away from the outer periphery of the polishing object during a polishing operation, there is no danger of tilting the grinding member because the grinding member is supported also by the dresser disk. This arrangement eliminates the need for a separate table to prevent tilting, and provides an additional benefit in that dressing of the abrasive surface of the grinding member can be performed concurrently with polishing of the surface of the object. Therefore, there is no need to provide a separate dressing step to dress the abrasive surface of the grinding member, thereby increasing the polishing efficiency and providing a compact apparatus.

According to the present invention, a plural of object holders and a plural of dresser disk holders may be disposed for polishing a plurality of objects while the grinding member is being dressed by the plurality of dresser disks.

Accordingly, one grinding member can process a plurality of objects while being processed by a plurality of dresser disks, so that the polishing and dressing productivity is increased and the overall efficiency of the polishing operation is improved.

According to the present invention, a grinding member monitoring device may be provided to check conditions of a dressed abrasive surface of the grinding member, and a control device may be provided to control dressing conditions according to output signals from the grinding member monitoring device.

Accordingly, dressing conditions can be optimized by providing a grinding member monitoring device and a dressing control device.

According to the present invention, a weight limiting device may be provided so as to control a pressure exerted on the surface to be polished by the grinding member.

Accordingly, the polishing load can be decreased to a level, which is lower than the weight of the grinding member by providing a suspending device, which also facilitates vertical movements of a main pressing device to enable fine adjustment in pressure control.

The above and other objects, features, and advantages of the present invention will become apparent from the following description when taken in conjunction with the accompanying drawings, which illustrate a preferred embodiment of the present invention by way of example.

BRIEF DESCRIPTION OF THE DRAWINGS

In the drawings of FIG. 1 through FIG. 8, same parts or same portions are given the same reference numerals, and their repeated explanations are omitted.

DETAILED DESCRIPTION OF THE PREFERRED EMBODIMENTS

Figure 1:
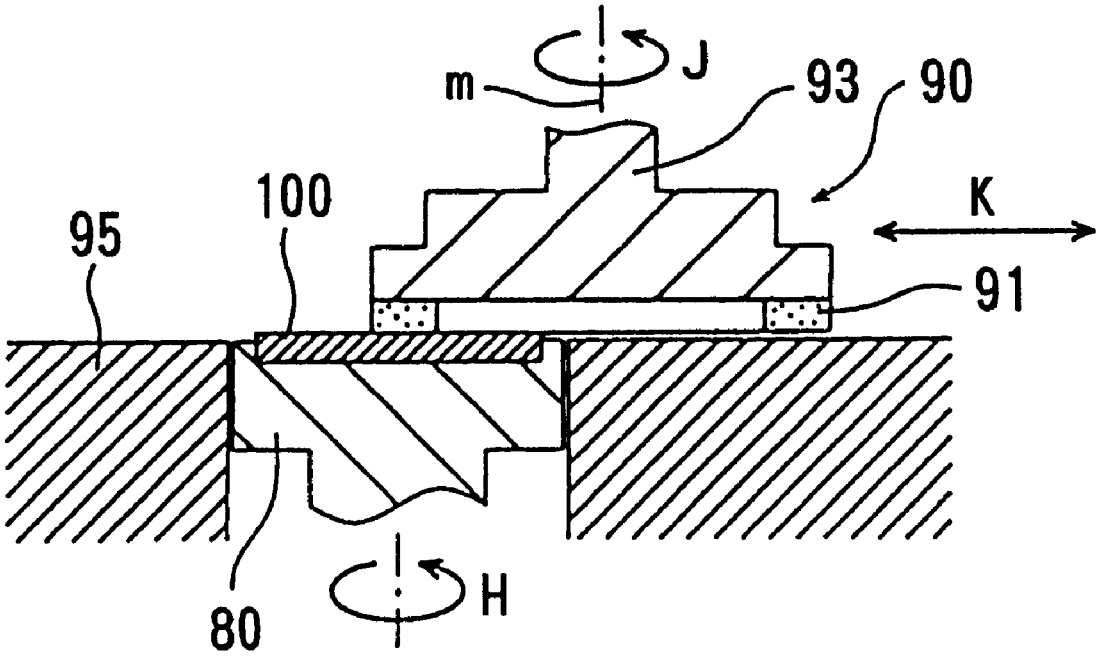
FIG. 1 is a cross sectional view of the fundamental portion of a conventional cup-type polishing apparatus having a grinding wheel.
Figure 2:
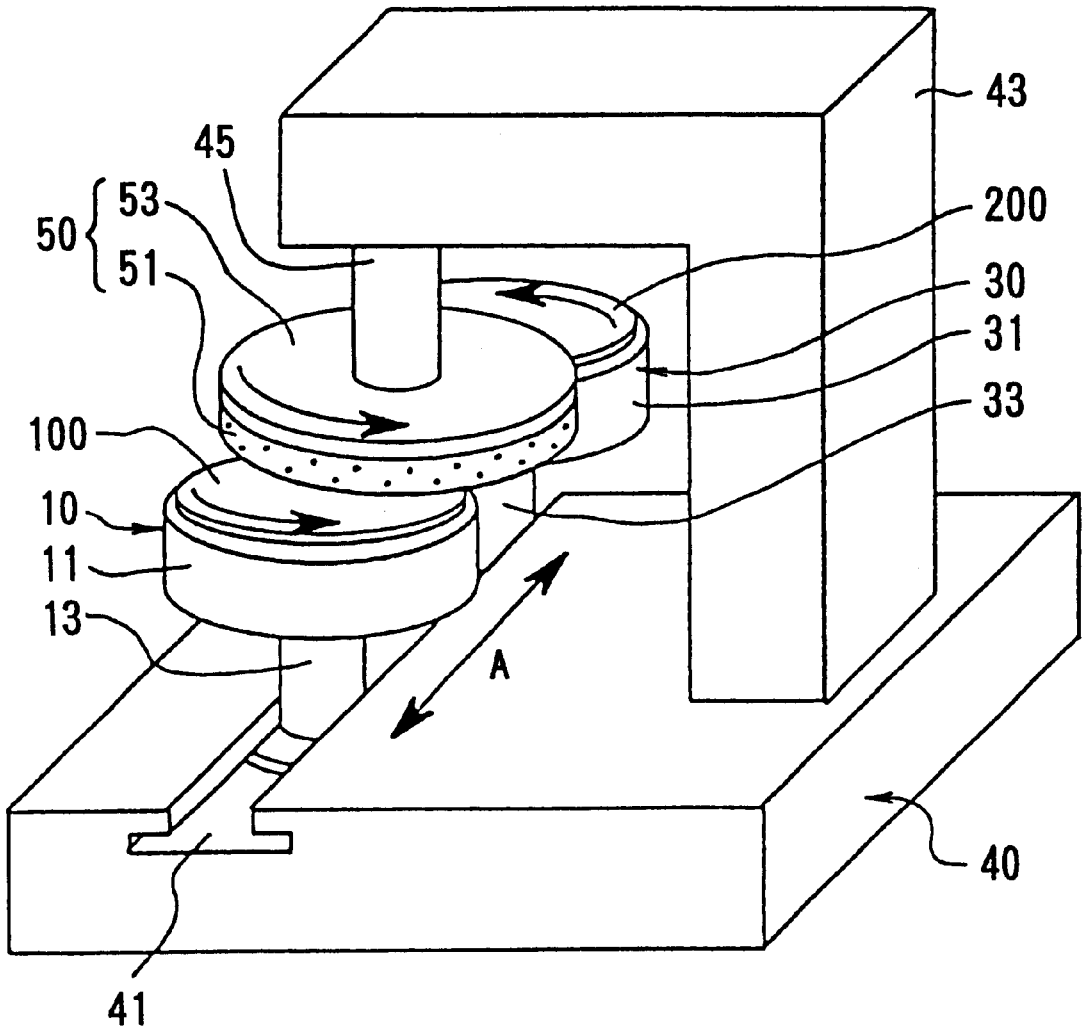
FIG. 2 is a perspective view of a polishing apparatus having a grinding wheel in a first embodiment of the present invention.

FIG. 2 shows a first embodiment of the polishing apparatus. The apparatus comprises an object holder 10 for holding a polishing object 100, such as a semiconductor wafer, which is movably fixed on a base section 40, and a dresser disk holder 30 for holding a dresser disk 200, which is movably fixed on the base section 40. A cup-type grinder 50 is attached to the bottom part of a drive shaft 45 extending from an end of an L-shaped arm section 43, which is fixed on the base section 40. Details of the components will be presented below.

Object holder 10 comprises a holder body 11 and a support rod 13 extending from the bottom center of the holder body 11, which is rotated by an internal drive (not shown). Hence, object holder 10 holds and rotates a wafer 100 to be polished by the grinder 50.

Dresser holder 30 comprises a disk body 31 which holds a disk-shaped dresser 200, and a support rod 33 extending from the bottom center of the disk body 31, which is rotated by an internal drive (not shown). The dresser 200 has a dressing surface, which is made of a metal disk having diamond particles of #400 particle size thereon by electroplating, or diamond particles of #400 particle size fixed on a abrading sheet attached thereon.

The surfaces of the wafer 100 and the dresser disk 200 are disposed so as to be coplanar.

The top surface of the base section 40 is provided with a guide groove 41, and the support rods 13, 33 for the object holder 10 and the dresser disk holder 30, respectively, are engaged in the groove 41. The support rods 13, 33 are moved in a reciprocating linear pattern in the groove 41 in the direction shown by the arrow A, by virtue of a drive mechanism (not shown) while maintaining their separation distance constant.

The cup-type grinding wheel 50 comprises a ring-shaped grinder 51 (or small pieces of grinding pellets arranged in a ring shape). The grinder 50 is rotated by a drive shaft 45 of a drive device (not shown) inside the arm section 43. The grinder 50 is disposed so that the abrasive surface of the grinding wheel 51 can straddle both the wafer 100 and the dresser disk 200, and contact both the surface to be polished of the wafer 100 and the dressing surface of the dresser disk 200.

Figure 3A:
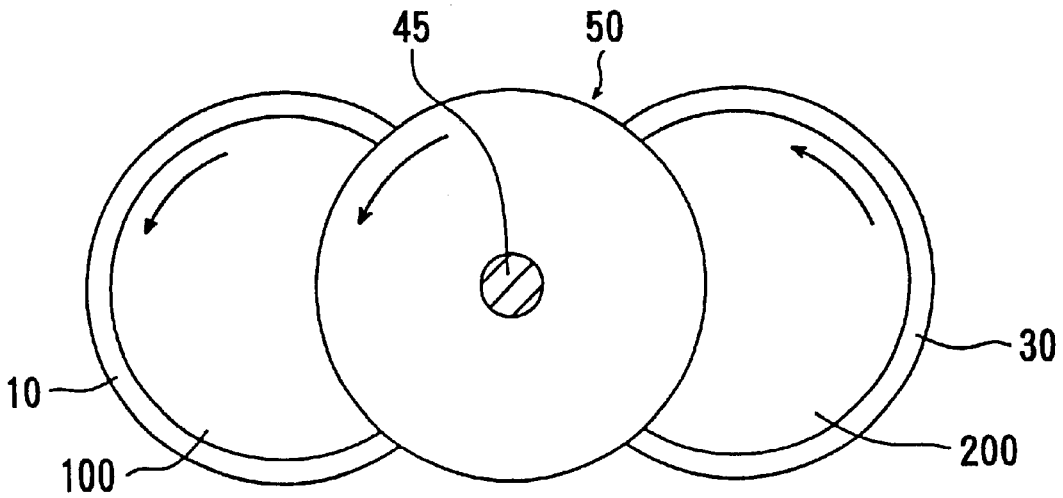
FIGS. 3A and 3B are, respectively, a plan view and a cross sectional view of the fundamental portion of the polishing apparatus shown in FIG. 2.
Figure 3B:
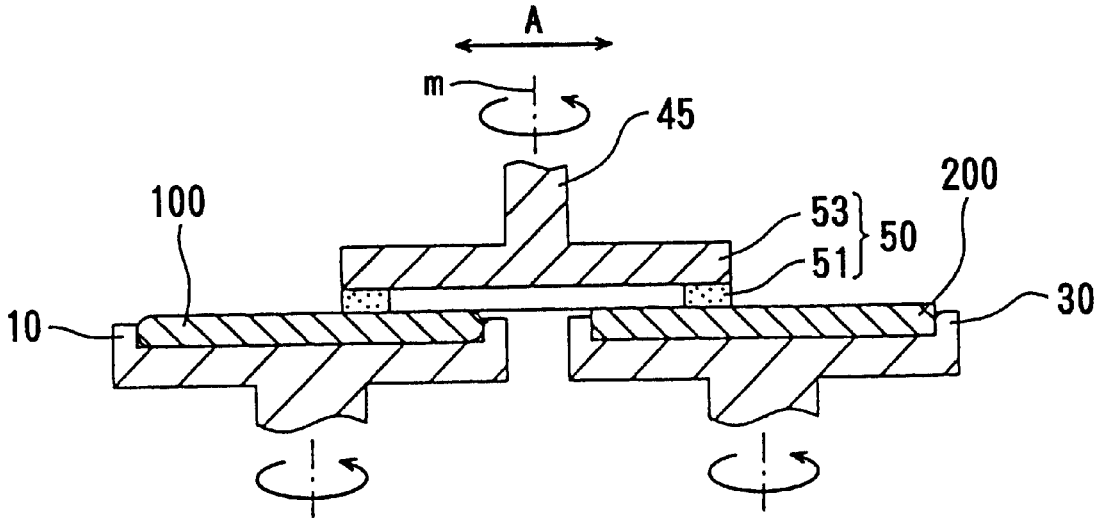

Referring to FIGS. 3A and 3B, the wafer holder 10, dresser holder 30 and the grinder 50 are independently driven. Polishing operation is carried out by rotating the holders 10, 30 and the grinder 50 at the same time, while linearly reciprocating the wafer holder 10 and the dresser holder 30 relative to the grinder 50 in the direction of the arrow A, while maintaining the distance of separation between the holder 10 and the holder 30 constant. This arrangement enables the grinder 50 to polish the entire surface of the wafer 100 and, at the same time, to have the abrasive surface of the grinding wheel 51 be dressed by being in contact with the dresser disk 200.

Even if the rotation center of the grinding wheel 51 moves away from the outer periphery of the surface to be polished of the wafer 100, the grinding wheel 51 remains supported by the surface of the dresser disk 200 so that there is no danger of tilting the grinding wheel 51.

Figure 4A:
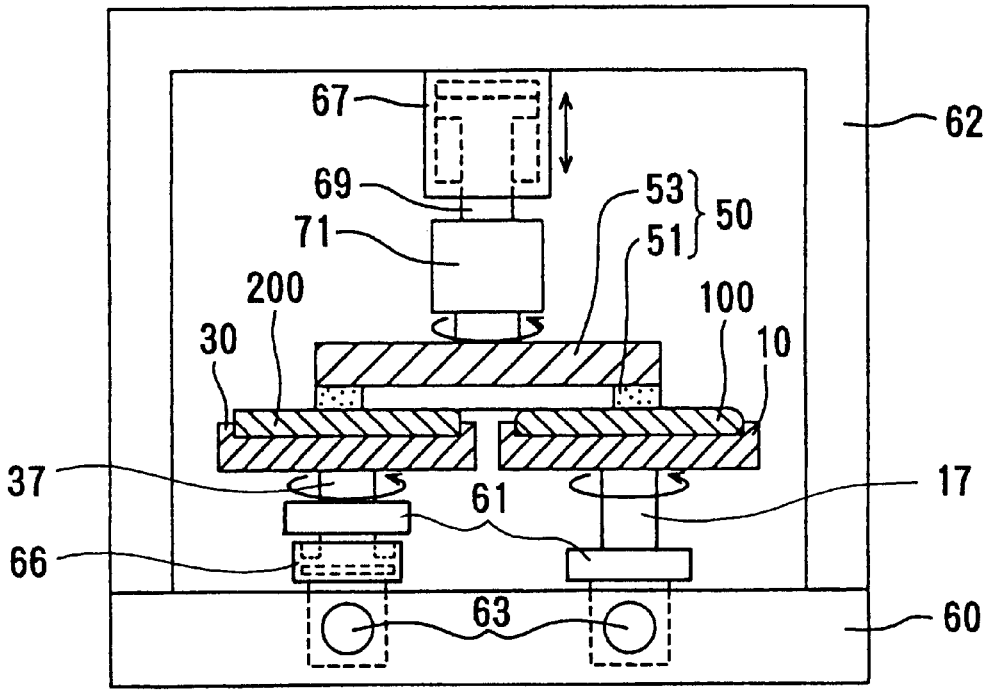
FIGS. 4A and 4B are, respectively, a side view and a plan view of the fundamental portion of the polishing apparatus in a second embodiment of the present invention.
Figure 4B:
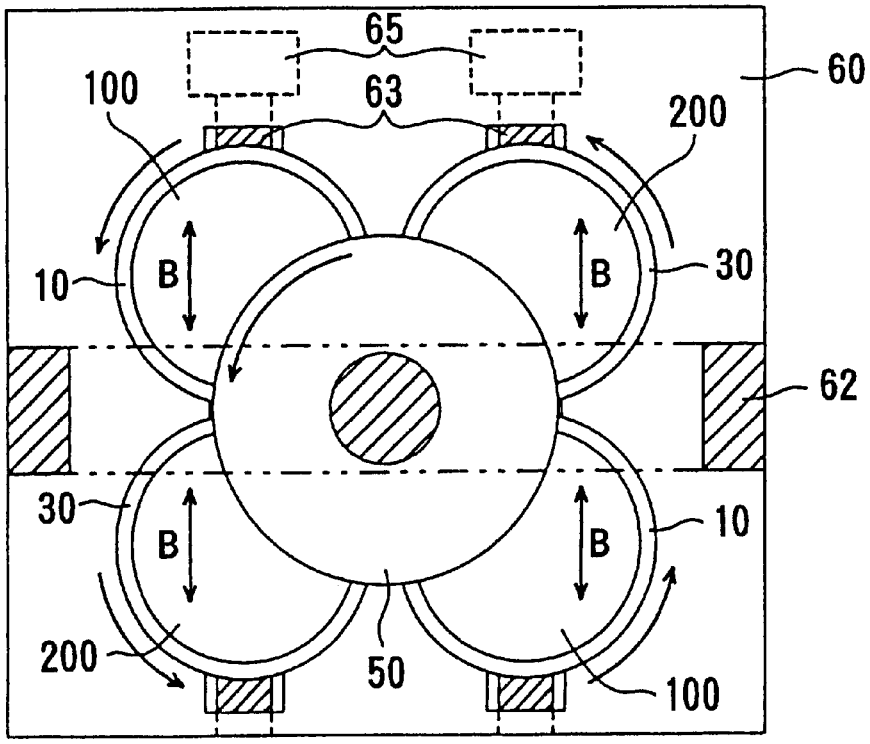

FIGS. 4A and 4B show a second embodiment of the polishing apparatus having a grinding wheel, in which an arm section 62 is indicated by double-dot lines.

The polishing apparatus includes a pair of wafer holders 10, 10 and dresser holders 30, 30 disposed alternately in a square pattern. A grinding wheel 50 is disposed in the center of and above the square pattern.

Each of the wafer holders 10, 10 and dresser holders 30, 30 is driven by a respective drive motor 61 attached to a respective shaft 17, 37, and a dresser pushing cylinder 66 (dresser pushing device) for pushing the dresser disk 200 is attached to the underside of the drive motor 61 for the dresser holder 30. Also, the left pair and the right pair of the wafer holder 10 and dresser holder 30 are each driven linearly in the direction of the arrows B by the rotation of ball screws 63, 63, which are disposed below the respective dresser pushing device 66 and the drive motor 61, and which are driven by respective motors 65, 65. The drive motors 65, 65 are variable speed motors so as to control the reciprocating motion of each pair the wafer holder 10 and the dresser holder 30 at any desired speed independently of the other pair in the direction of the arrows B. As in the first embodiment, the surfaces of the wafers to be polished and the dressing surfaces of the dresser disks 200 are disposed so as to be coplanar.

The grinder 50 is attached to a drive motor 71 installed on a press rod 69 of a pressing cylinder 67 (pressing mechanism), which is fixed to the center of the arm section 62 disposed above a base section 60.

In this apparatus, two wafers 100, 100 can be polished simultaneously by placing the wafers in respective wafer holders 10, 10 and rotating the two pairs of wafer holder 10 and the dresser holder 30 by using the four respective drive motors 61, while rotating the grinding wheel 50 by using the drive motor 71. At the same time, the abrasive surface of the grinding wheel 51 is pressed against the surfaces to be polished of the wafers 100, 100 and the dresser disks 200, 200 by lowering the grinding wheel 51 via the pressing cylinder 67, and the drive motors 65 are operated so that the wafer holders 10, 10 and the dresser holders 30, 30 are linearly moved in the direction of the arrows B. This procedure results in producing two uniformly polished wafers over their entire surfaces, as well as in performing a concurrent dressing operation on the grinding wheel 51 of the cup-type grinder 50.

In the dressing operation, the pressing force of the dresser holder 30 can be adjusted by using the dresser pushing device 66 to press the dresser disk 200 against the abrasive surface of the grinding wheel 51. The reason for providing the dresser pushing device 66 is explained in the following. If there is no pushing device for the dresser disk 200, the surface to be polished of the wafer 100 and the dressing surface of the dresser disk 200 will be subjected to the same pressure exerted by the pressing cylinder 67. However, this single-valued pressure is sometimes too high or too low for the dresser disk 200. If the dressing pressure which is applied to the grinding wheel 51 is too high, service life of the grinding wheel 51 is significantly decreased. For this reason, a separate pushing device 66 is provided for the dresser holder 30 so that the load on the dresser disk 200 may be adjusted relative to the load applied on the surface to be polished of the wafer 100. More specifically, for a dresser disk 200 having electroplated #100 diamond particles, for example, the stress on the dresser disk 200 should be less than 10 gf./cm$^2$ (981 Pa). This value should be changed depending on various conditions used in polishing the wafer 100. Also, instead of using an air cylinder, a combination of motor and gears may be used for the dresser pushing device.

It is preferable that the dresser pushing device 66 is used, in the manner presented in this embodiment, in conjunction with two or more wafer holders 10, each holding a wafer 100, which are served by one grinding wheel 51 straddling the wafer holders. In such an arrangement, even if the grinding wheel moves anywhere, the design is such that the grinding wheel is always supported reliably by a plurality of wafers or polishing objects. The reason is that when the grinding wheel 51 is used in conjunction with a pair of one wafer 100 and one dresser disk 200, if the pressure exerted by dresser disk 200 on the grinding wheel 51 is altered, there is a danger that the pressure exerted by the grinding wheel 51 on the wafer 100 may change or that the grinding wheel 51 may become tilted, causing deviation from the optimum polishing conditions. If there is no fear of such problems or the problems can be eliminated in some way it is quite acceptable to provide a dresser pushing device for the polishing apparatus in the first embodiment.

It is obvious that the number of wafer holders 10 and the dresser holders 30 can be changed to suit various applications.

Figure 5A:
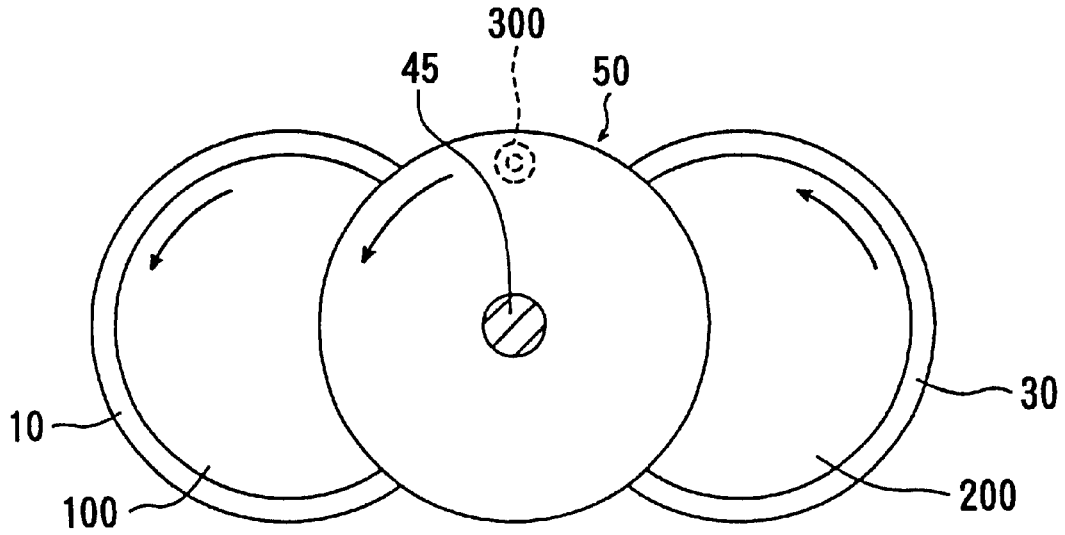
FIGS. 5A and 5B are, respectively, a plan view and a cross sectional view of the fundamental portion of the polishing apparatus in a third embodiment of the present invention.
Figure 5B:
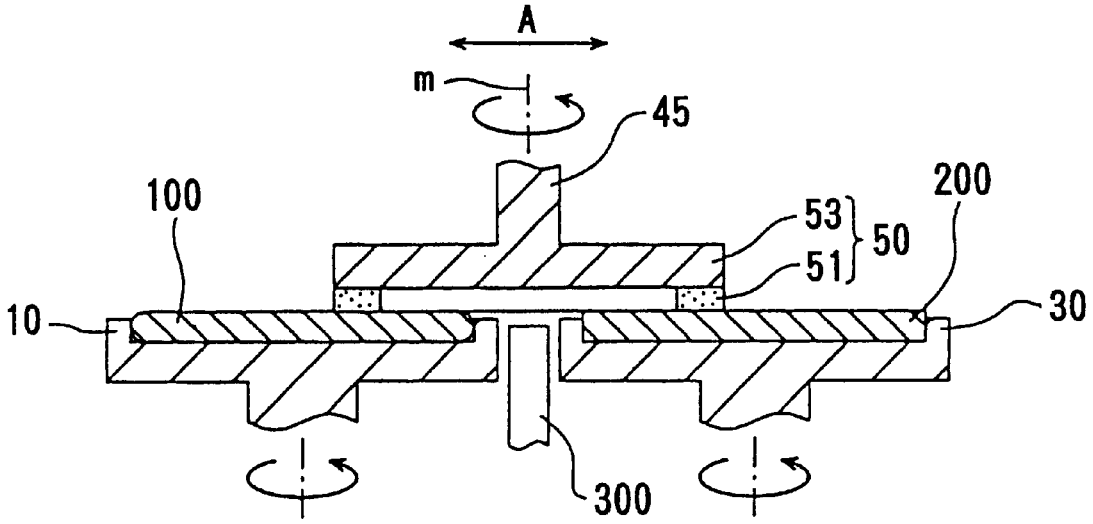

FIGS. 5A and 5B show a third embodiment of a polishing apparatus having a grinding wheel.

Figure 6:
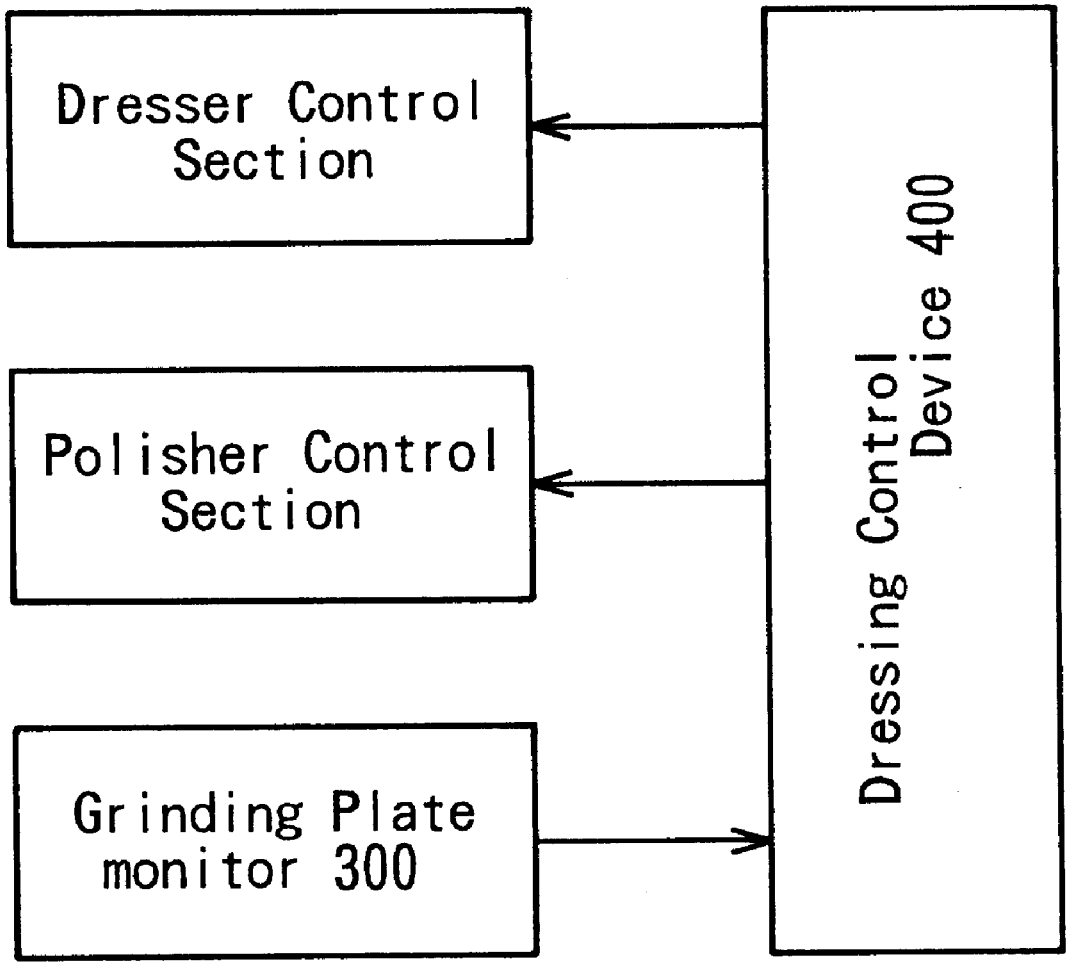
FIG. 6 is a block diagram of a regeneration device.

The differences between the first and the third embodiments are that the condition of the abrasive surface of the grinding wheel 51 is monitored by a grinding wheel monitor 300 disposed in an appropriate location, and that the dressing parameters can be modified by a dressing control device 400, according to the feedback signals from the grinding wheel or plate monitor 300, as shown in FIG. 6.

FIG. 6 shows a block diagram of the dressing control device 400, which varies dressing conditions for the grinding wheel 51 by controlling the operations of the dresser-control section and the polisher-control section, according to output signals from the grinding wheel monitor 300. For example, if it is determined that the grinding wheel 51 has not been dressed sufficiently, the pushing pressure on the dresser disk 200 may be increased or the rotational speed of the dresser disk 200 may be increased.

In short, a property of the dressed surface of the grinding wheel, is represented typically by a certain level of surface roughness value. It may be monitored by the grinding wheel monitor 300, and output signals can be input into the dressing control device 400 through a feedback circuit to control the dressing parameters (for example, contact pressure between the dresser disk 200 and the grinding wheel 51) so that optimum dressing can be achieved at all times.

The grinding wheel monitor 300 may be a non-contact type transducer (optical, acoustic and the like), or contact type transducers (vibration or friction detection types or torque detection types). But it is obvious that any kind of monitor will be satisfactory if the monitor is sufficiently able to detect the dressed conditions of the abrasive surface of the grinding wheel 51.

It would be evident that the third embodiment can be applied to the second embodiment or the following fourth and fifth embodiments.

Figure 7A:
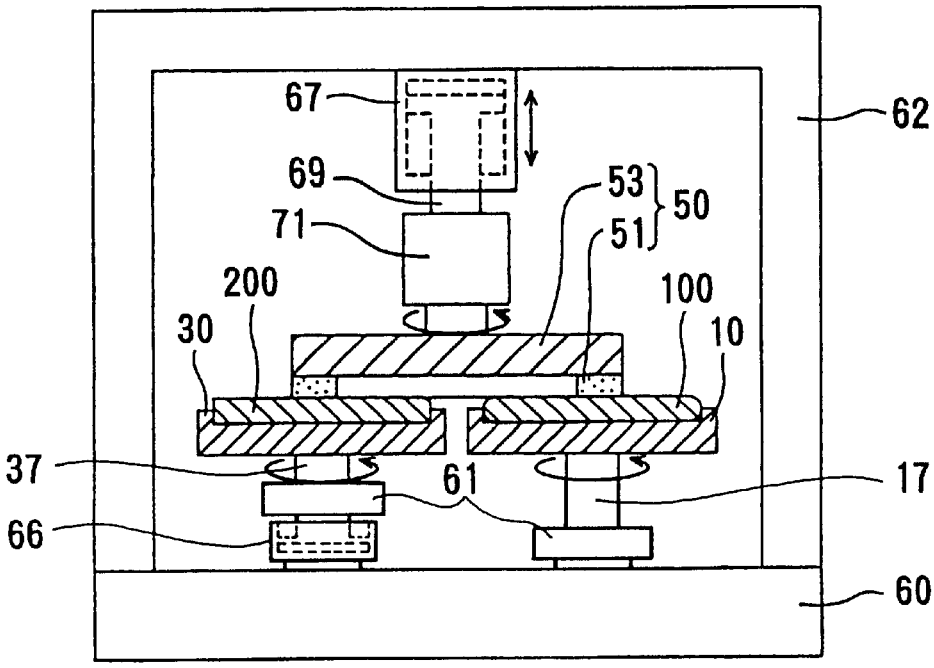
FIGS. 7A and 7B are, respectively, a side view and a plan view of the polishing apparatus in a fourth embodiment.
Figure 7B:
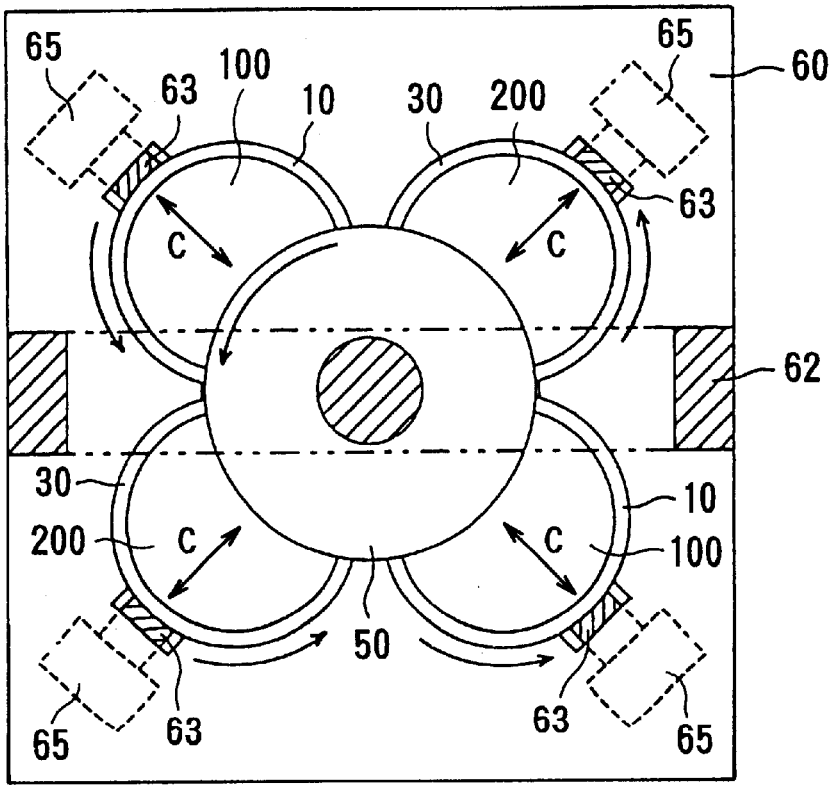

FIGS. 7A and 7B show the polishing apparatus in a fourth embodiment, in which an arm section 62 is indicated by double-dot lines.

The difference between the fourth embodiment and the second embodiment shown in FIGS. 4A and 4B is that each wafer holder 10, 10 and dresser holder 30, 30 is independently movable in radial directions about the center of rotation of the grinder 50. More specifically, respective drive motors 65 are used to rotate the ball screws 63 to drive the wafer holders 10, 10 and the dresser holders 30, 30 independently in the direction of the arrows C.

The reason for independent reciprocal movement for the wafer holders 10, 10 and the dresser holders 30, 30 is to enable fine adjustments of the polishing conditions for the wafer 100 and the dressing conditions for the grinding wheel 51 by the dresser disk 200.

The reason for the reciprocal movement of the wafer holders 10, 10 and the dresser holders 30, 30 in radial directions about the center of rotation of the grinder 50 is to ensure that any wafer 100 or dresser disk 200 will be subjected to the grinding wheel 51 in relatively the same area at the same time (the same relative location and the same contact area). Therefore, all the wafers 100 and dresser disks 200 are respectively subjected to the same conditions of the grinding wheel 51.

Figure 8:
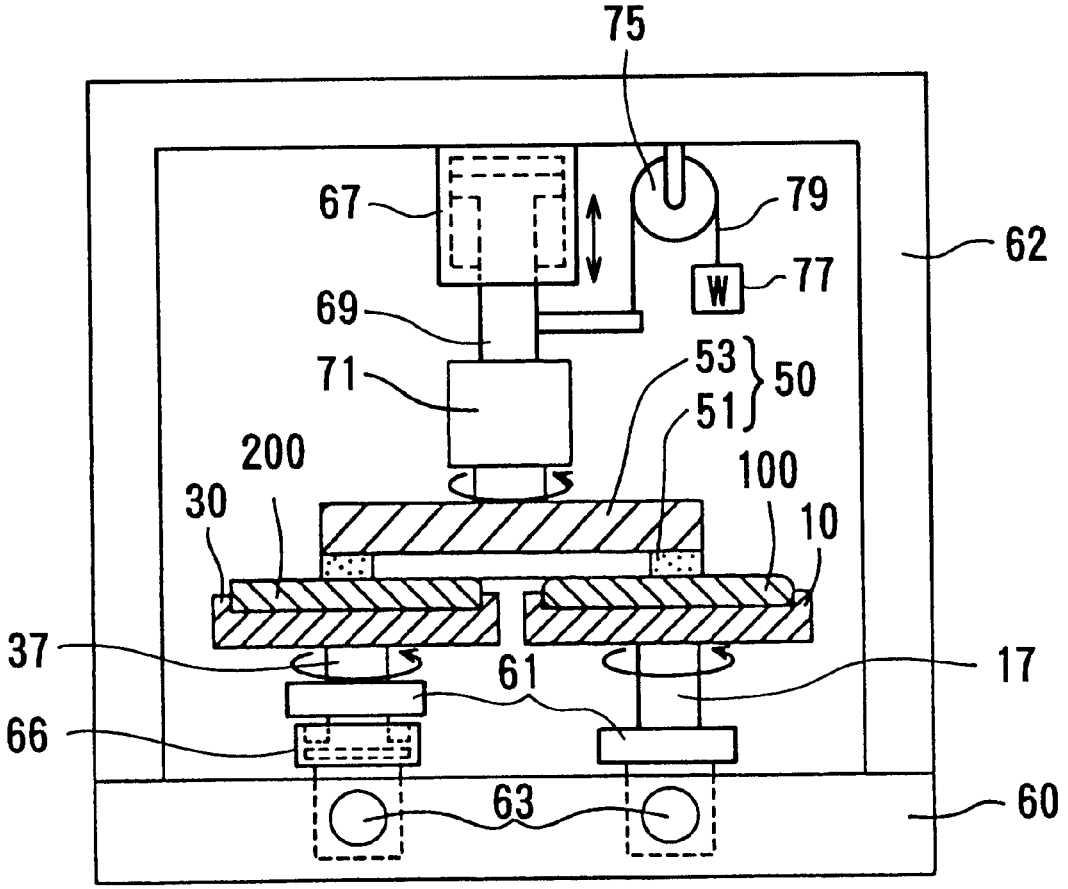
FIG. 8 is a partial cross sectional view of the polishing apparatus in a fifth embodiment of the present invention.

FIG. 8 shows a polishing apparatus in a fifth embodiment. This apparatus is different than the second embodiment apparatus shown in FIGS. 4A and 4B in that a weight limiting device is provided for the grinder 50. More specifically, a weight 77 is attached by a rope 79 to the press rod 69 through a pulley 75 to reduce the load applied on the wafer by the grinder 50.

This arrangement enables the reduction or elimination of the load exerted by the weight of the grinder 50 on the wafer 100, thereby enabling polishing of the wafer 100 with a load that is less than the weight of the grinder 50. Also, it is possible to reduce the load exerted by the pressing cylinder 67 that is necessary to lift the grinder 50, so that the movement of the grinder 50 can be controlled precisely. This arrangement is also effective in reducing the load applied to the dresser disk 200.

Other arrangements for limiting the weight of the grinder 50 may be applied. The weight limiting device can be attached to any location other than the press rod 69 so long as that location is on the grinder 50. The weight limiting device can be applied to any of the foregoing embodiments but also to other types of polishing apparatus. The weight limiting device is applicable to any type of polishing apparatus in which polishing is performed by pressing an overhead grinding wheel on a polishing object while producing a relative sliding motion therebetween.

Although a certain preferred embodiment of the present invention has been shown and described in detail, it should be understood that various changes and modifications may be mad therein without departing from the scope of the appended claims.

For example, in the above examples, polishing apparatus having a cup-type grinding wheel were explained, however the present inventions is applicable not only to polishing apparatus having a grinding wheel as above mentioned, but also to polishing apparatus having a grinding member such as a disk shape and other shapes. The pressing cylinder 67 also may be replaced with other types of pushing devices, such as a motor driven pressing device.

Also, in some cases, the present polishing apparatus having a grinding wheel may be combined with a conventional CMP apparatus having a polishing cloth and polishing slurry so that the CMP process may be performed either before or after the polishing process performed by using a grinding member.

What is claimed is:

1. A polishing apparatus for polishing an object, comprising:

a grinding member having an abrasive surface to polish a surface of the object;

an object holder to hold the object having the surface to be polished;

a dresser disk holder to hold a dresser disk having a dressing surface for dressing said abrasive surface of said grinding member, said grinding member being positionable such that said abrasive surface straddles the dressing surface oft he dresser disk and the surface of the object so as to define an exposed portion of said abrasive surface that is not covered by any of the object and the dresser disk;

a grinding member monitoring device to detect a property of a dressed area of said abrasive surface at the exposed portion; and a control section to control a dressing parameter in response to an output signal from said grinding member monitoring device that corresponds to the property detected by said grinding member monitoring device.

2. The polishing apparatus according to claim 1, wherein said abrasive surface of said grinding member faces downwardly, and the surface of the object and the dressing surface of the dresser disk face upwardly when the object is held by said object holder and the dresser disk is held by said dresser disk holder.

3. The polishing apparatus according to claim 2, wherein there are plural object holders to hold plural objects to be polished, respectively, and wherein there are also plural dresser disk holders to hold plural dresser disks, respectively.

4. The polishing apparatus according to claim 1, wherein there are plural object holders to hold plural objects to be polished, respectively, and wherein there are also plural dresser disk holders to hold plural dresser disks, respectively.

5. The polishing apparatus according to claim 4, wherein a pair of object holders and a pair of dresser disk holders are disposed in an alternated square pattern, and said grinding member for polishing a pair of objects held by said pair of object holders, and for being polished by a pair of dresser disks held by said pair of dresser disk holders, is disposed in a center of the square pattern.

6. The polishing apparatus according to claim 5, and further comprising a system to linearly move any one of said plural object holders and dresser disk holders relative to any other one of said plural object holders and dresser disk holders.

7. The polishing apparatus according to claim 4, wherein a control device is provided to move any one of said plural dresser disk holders toward and away from said grinding member relative to said plural object holders, to adjust the force applied by the plural dresser disks against said grinding member.

8. The polishing apparatus according to claim 4, wherein a control device is provided to move said grinding member toward and away from said plural object holders to adjust the force applied by said grinding member against the plural objects.

9. The polishing apparatus according to claim 4, wherein a control device is provided to linearly move one of said plural object holders and one of said plural dresser disk holders as a unit relative to another of said plural object holders and another of said plural dresser disk holders.

10. The polishing apparatus according to claim 9, wherein the control device is also provided to linearly move said another of said plural object holders and said another of said plural dresser disk holders as a unit relative to said one of said plural object holders and said one of said plural dresser disk holders.

11. The polishing apparatus according to claim 4, and further comprising a device to move any one of said plural dresser disk holders towards and away from said grinding member relative to said plural object holders.

12. The polishing apparatus according to claim 4, and further comprising a device to move said grinding member towards and away from said plural object holders and dresser disk holders.

13. The polishing apparatus according to claim 4, wherein a weight reducing device is provided so as to control a pressure exerted by said grinding member on the surfaces to be polished.

14. The polishing apparatus according to claim 1, wherein a weight reducing device is provided so as to control a pressure exerted by said grinding member on the surface to be polished.

15. The polishing apparatus according to claim 1, wherein said grinding member comprises a cup-type grinding wheel.

16. The polishing apparatus according to claim 1, wherein said grinding member comprises a polishing pad.

17. The polishing apparatus according to claim 1, wherein said abrasive surface includes abrading particles bound to said grinding member.

18. The polishing apparatus according to claim 1, wherein said grinding member has a diameter that is less than a sum of a diameter of said object holder plus a diameter of said dresser disk holder.

19. The polishing apparatus according to claim 1, wherein said grinding member is centrally disposed above a combination of said object holder and said dresser disk holder.

20. The polishing apparatus according to claim 1, and further comprising a device to linearly move said object holder and said dresser disk holder as a unit relative to said grinding member.

21. The polishing apparatus according to claim 1, wherein said grinding member monitoring device is to detect a property of the dressed area of said abrasive surface at the exposed portion by detecting the property of the dressed area of said abrasive surface at the exposed portion before the dressed area comes into contact with the object.

22. The polishing apparatus according to claim 21, wherein said abrasive surface of said grinding member faces downwardly, and the surface of the object and the dressing surface of the dresser disk face upwardly when the object is held by said object holder and the dresser disk is held by said dresser disk holder.

23. The polishing apparatus according to claim 22, wherein there are plural object holders to hold plural objects to be polished, respectively, and wherein there are also plural dresser disk holders to hold plural dresser disks, respectively.

24. The polishing apparatus according to claim 21, wherein there are plural object holders to hold plural objects to be polished, respectively, and wherein there are also plural dresser disk holders to hold plural dresser disks, respectively.

25. The polishing apparatus according to claim 24, wherein a pair of object holders and a pair of dresser disk holders are disposed in an alternated square pattern, and said grinding member for polishing a pair of objects held by said pair of object holders, and for being polished by a pair of dresser disks held by said pair of dresser disk holders, is disposed in a center of the square pattern.

26. The polishing apparatus according to claim 25, and further comprising a system to linearly move any one of said plural object holders and dresser disk holders relative to any other one of said plural object holders and dresser disk holders.

27. The polishing apparatus according to claim 24, wherein a control device is provided to move any one of said plural dresser disk holders toward and away from said grinding member relative to said plural object holders, to adjust the force applied by the plural dresser disks against said grinding member.

28. The polishing apparatus according to claim 24, wherein a control device is provided to move said grinding member toward and away from said plural object holders to adjust the force applied by said grinding member against the plural objects.

29. The polishing apparatus according to claim 24, wherein a control device is provided to linearly move one of said plural object holders and one of said plural dresser disk holders as a unit relative to another of said plural object holders and another of said plural dresser disk holders.

30. The polishing apparatus according to claim 29, wherein the control device is also provided to linearly move said another of said plural object holders and said another of said plural dresser disk holders as a unit relative to said one of said plural object holders and said one of said plural dresser disk holders.

31. The polishing apparatus according to claim 24, and further comprising a device to move any one of said plural dresser disk holders towards and away from said grinding member relative to said plural object holders.

32. The polishing apparatus according to claim 24, and further comprising a device to move said grinding member towards and away from said plural object holders and dresser disk holders.

33. The polishing apparatus according to claim 24, wherein a weight reducing device is provided so as to control a pressure exerted by said grinding member on the surfaces to be polished.

34. The polishing apparatus according to claim 21, wherein a weight reducing device is provided so as to control a pressure exerted by said grinding member on the surface to be polished.

35. The polishing apparatus according to claim 21, wherein said grinding member comprises a cup-type grinding wheel.

36. The polishing apparatus according to claim 21, wherein said grinding member comprises a polishing pad.

37. The polishing apparatus according to claim 21, wherein said abrasive surface includes abrading particles bound to said grinding member.

38. The polishing apparatus according to claim 21, wherein said grinding member has a diameter that is less than a sum of a diameter of said object holder plus a diameter of said dresser disk holder.

39. The polishing apparatus according to claim 21, wherein said grinding member is centrally disposed above a combination of said object holder and said dresser disk holder.

40. The polishing apparatus according to claim 21, and further comprising a device to linearly move said object holder and said dresser disk holder as a unit relative to said grinding member.

41. The polishing apparatus according to claim 1, wherein said grinding member monitoring device is to detect a property of the dressed area of said abrasive surface by detecting a surface roughness of the dressed area.

42. The polishing apparatus according to claim 41, wherein said grinding member monitoring device is to detect a surface roughness of the dressed area of said abrasive surface by detecting the surface roughness of the dressed area of said abrasive surface before the dressed area comes into contact with the object.

* * * * *